US009243859B1

(12) United States Patent
Miller et al.

(10) Patent No.: US 9,243,859 B1
(45) Date of Patent: Jan. 26, 2016

(54) GAS BLOCK VALVE STEM FOR MODIFYING THE FIRING RATE OF A MACHINE GUN

(71) Applicant: FN America, LLC, McLean, VA (US)

(72) Inventors: Harold L. Miller, Lugoff, SC (US); Charles A. Moore, Columbia, SC (US); John M. Beville, Blythewood, SC (US)

(73) Assignee: FN AMERICA, LLC, McLean, VA (US)

( * ) Notice: Subject to any disclaimer, the term of this patent is extended or adjusted under 35 U.S.C. 154(b) by 0 days.

(21) Appl. No.: 14/565,789

(22) Filed: Dec. 10, 2014

Related U.S. Application Data

(60) Provisional application No. 61/928,240, filed on Jan. 16, 2014.

(51) Int. Cl.
*F41A 19/55* (2006.01)
*F41A 3/90* (2006.01)

(52) U.S. Cl.
CPC .. *F41A 19/55* (2013.01); *F41A 3/90* (2013.01)

(58) Field of Classification Search
CPC ..... F41A 19/55; F41A 3/90; F41A 3/92; F41A 5/28; F41A 5/26; F41A 5/18; F41A 5/20; F41A 5/22; F41A 5/24
USPC ..... 89/130, 129.01, 129.02, 193
See application file for complete search history.

(56) References Cited

U.S. PATENT DOCUMENTS 1,387,889 A * 8/1921 Johnston ..... F41A 5/26 89/193
1,799,981 A * 4/1931 Holek ..... F41A 3/32 42/71.01
2,369,669 A * 2/1945 Garand ..... F41A 5/28 251/216
2,393,627 A * 1/1946 Garand ..... F41A 5/26 89/193
2,456,290 A * 12/1948 Ljutic ..... F41A 5/26 89/193
2,582,989 A * 1/1952 Harvey ..... F41A 5/26 89/191.01
2,777,366 A * 1/1957 Cook ..... F41A 5/26 89/191.01
2,783,685 A * 3/1957 Green ..... F41A 5/28 297/248
2,918,848 A * 12/1959 Maillard ..... F41A 5/28 89/193
3,680,434 A * 8/1972 Muhlemann ..... F41A 5/28 89/193
3,707,110 A * 12/1972 Alday ..... F41A 5/28 89/193
3,779,131 A * 12/1973 Kawamura ..... F41A 5/26 89/191.02
3,795,173 A * 3/1974 Freymond ..... F16L 55/02772 89/193
3,968,727 A * 7/1976 Hyytinen ..... F41A 5/28 89/191.02
3,990,348 A * 11/1976 Vesamaa ..... F41A 5/28 89/191.02
4,702,146 A * 10/1987 Ikeda ..... F41A 5/28 89/193
5,959,234 A * 9/1999 Scaramucci ..... F41A 5/18 89/193
2002/0073832 A1* 6/2002 Vignaroli ..... F41A 5/18 89/191.01
2014/0000446 A1* 1/2014 Hall ..... F41A 5/28 89/129.01
2014/0083286 A1* 3/2014 Gomez ..... F41A 5/28 89/193
2014/0137730 A1* 5/2014 Beckmann ..... F41A 21/26 89/193
2015/0176933 A1* 6/2015 Adams ..... F41A 5/28 89/191.02

* cited by examiner

*Primary Examiner* — Joshua Freeman
(74) *Attorney, Agent, or Firm* — Michael A. Mann; Nexsen Pruet, LLC

(57) ABSTRACT

A reversible modification to the gas block of a machine gun reduces the rate of fire to the machine gun's design rate for use when a suppressor has been added to the barrel and which suppressor would, without the present modification, elevate the firing rate from the machine gun's design rate. The modification is the use of a stem inserted into the bore of the gas block nozzle to further limit the combustion gas being delivered to the machine gun's operating group. A hole formed in the stem restricts gas flow. The stem seats against the gas block nozzle and is held in place by the cap covering the gas block but may alternatively be held in place in several alternative ways described. Removal of the cap allows the stem to be removed from the gas block when the suppressor has been removed from the machine gun barrel.

8 Claims, 7 Drawing Sheets

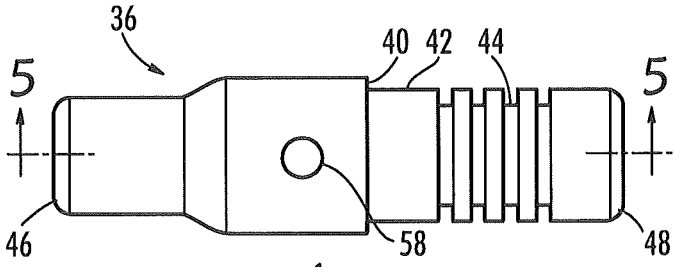
FIG.4
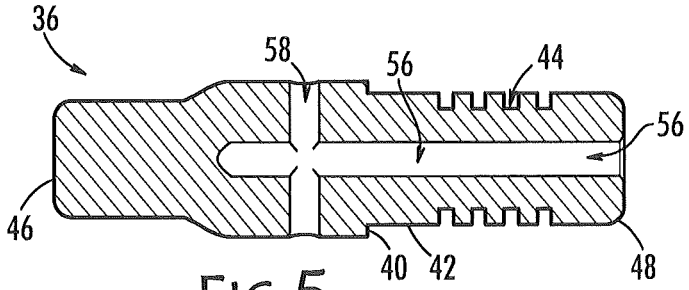
FIG.5
FIG.6
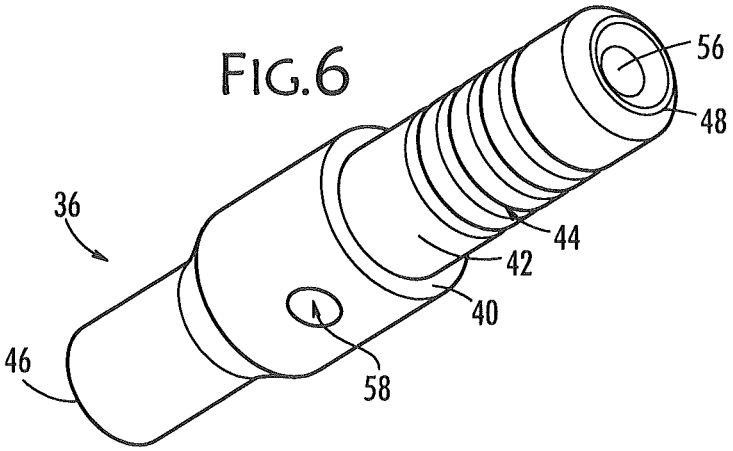

GAS BLOCK VALVE STEM FOR MODIFYING THE FIRING RATE OF A MACHINE GUN

BACKGROUND OF THE INVENTION

The firing rate of a machine gun is determined in major part by a gas block. The gas block redirects a portion of combustion gases from the barrel to the operating group for quickly chambering the next round. The machine gun's ability to sustain a high rate of fire makes it an effective combat weapon.

When a machine gun is used with a sound suppressor, the back pressure from the suppressor elevates the normal cyclic rate of fire but reduces the reliability of the firearm because of that elevated rate. There needs to be a way to preserve reliability of the machine gun when a suppressor is used.

SUMMARY OF THE INVENTION

According to its major aspects and briefly recited, the present invention is a reversible modification to the gas block of a machine gun to reduce the rate of fire to the machine gun's design rate when a suppressor has been added to the barrel and which suppressor would otherwise elevate the firing rate from the design rate. The combination of the suppressor and the modification to the gas block maintains the firing rate to that comparable to the design rate. The modification is the use of a stem inserted in the bore of the gas block to limit the combustion gas being delivered to the machine gun's operating group. The stem seats against the gas block nozzle and the cap covering the gas block but may alternatively be held in place in several alternative ways.

DESCRIPTION OF THE DRAWINGS

FIG. 4 is a bottom, exterior side view of the stem, according to an embodiment of the present invention;

FIG. 5 is a side, cross-sectional view of the stem shown in FIG. 4;

FIG. 6 is an exterior, bottom, end perspective view of the stem shown in FIG. 4;

DETAILED DESCRIPTION OF EMBODIMENTS OF THE INVENTION

The present invention is a reversible modification of the operation of a conventional gas block of a machine gun, such as the Mk48 machine gun, to reduce its firing rate when a sound suppressor is applied to the muzzle of the gun. Use of this modification preserves the firing rate during sustained fire when the suppressor is attached and thereby preserves reliability and limits the heating of the barrel. The present invention thereby prolongs barrel life from what it would be in the absence of this modification. When the suppressor is removed, the modification of the gas block may be reversed to restore the normal firing rate.

Figure 1:
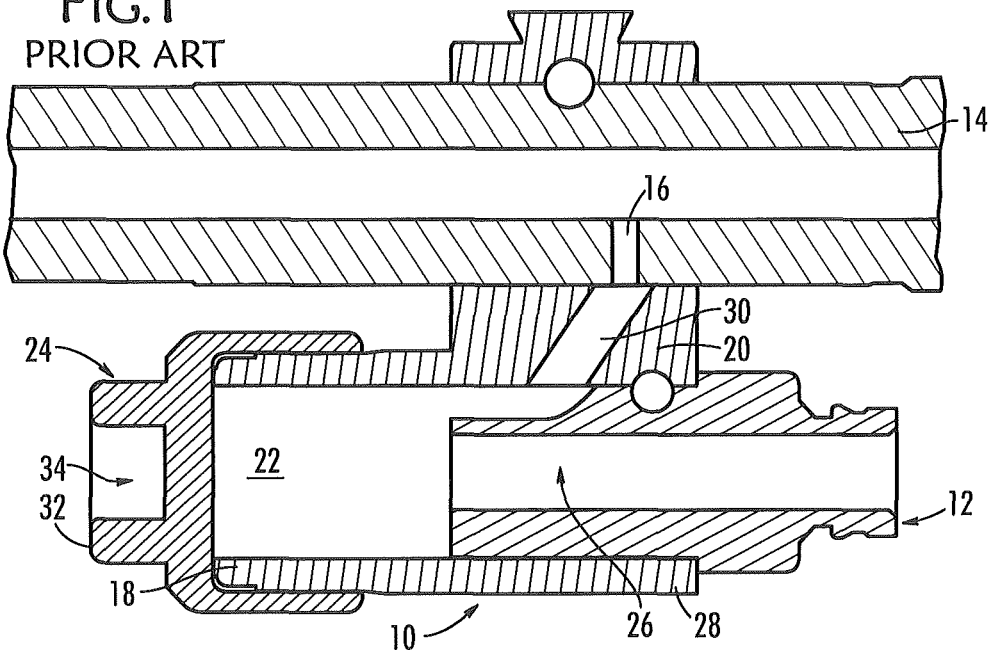
FIG.1 PRIOR ART
FIG. 1 is a side, cross-sectional view of a portion of a machine gun barrel and an attached, prior art gas block.

As seen in FIG. 1, a prior art gas block 10 is affixed to a barrel 14 of a gun so that a nozzle 12 is held in fluid communication with a hole 16 in barrel 14. Hole 16 allows a portion of the combustion gases that result from the firing of a bullet to be redirected for use by the operating group. Gas block 10 includes a generally cylindrical body 20, which is attach to barrel 14, and which has an interior cavity 22. Body 20 has a first end 18 carrying a cap 24 and an opposing second end 28 that carries nozzle 12. Nozzle 12 has an axial bore 26 formed in nozzle 12. Hole 16 in barrel 14 is in fluid communication with cavity 22 via a passage 30 formed though body 20 of gas block 10 that leads from barrel 14 to bore 26 of nozzle 12.

Hole 16, passage 30, cavity 22 and bore 26 define a fluid path through from barrel 14 through body 20 and nozzle 12 of gas block 10 for a portion of combustion gases to flow for use in the operation of the operating group of the machine gun in a manner that is well known in the prior art. Specifically, nozzle 12 diverts combustion gas from barrel 14 to drive a piston that operates the operating group of the machine gun (piston and gun and connections thereto are not shown). In addition, gas block 10 in its connection to barrel 14 may also provide a structural platform to support the front sight attachment (not shown in FIG. 1).

Cap 24 on gas block 10 is a removable cover that permits access to cavity 22 for cleaning debris from gas block 10 as part of routine gas block maintenance. Cap 24 is threaded to the body 20 of gas block 10 and, conveniently, a first end 32 of cap 24 has a hexagonal exterior shape to permit use of a wrench to tighten and loosen cap 24 from body 20. First end 32 of cap 24 may also have a recess 34 formed therein to reduce weight.

The present invention is modification to gas block 10 that at least includes a stem 36, as shown in FIGS. 2-6. Stem 36 reduces the firing rate of a machine gun that has a suppressor to a rate approximately the same as the normal rate of the machine gun without a suppressor. Just as a suppressor may be removed; stem 36 may be removed and is not a permanent change to gas block 10. No change is required to machine gun barrel 14, to body 20, to end cap 24, or to nozzle 12 of gas block 10 in order to accommodate or install stem 36 in the embodiment shown in FIGS. 2-6, and, importantly, stem 36 can be easily removed at any convenient time, such as whenever the suppressor is removed.

Figure 2:
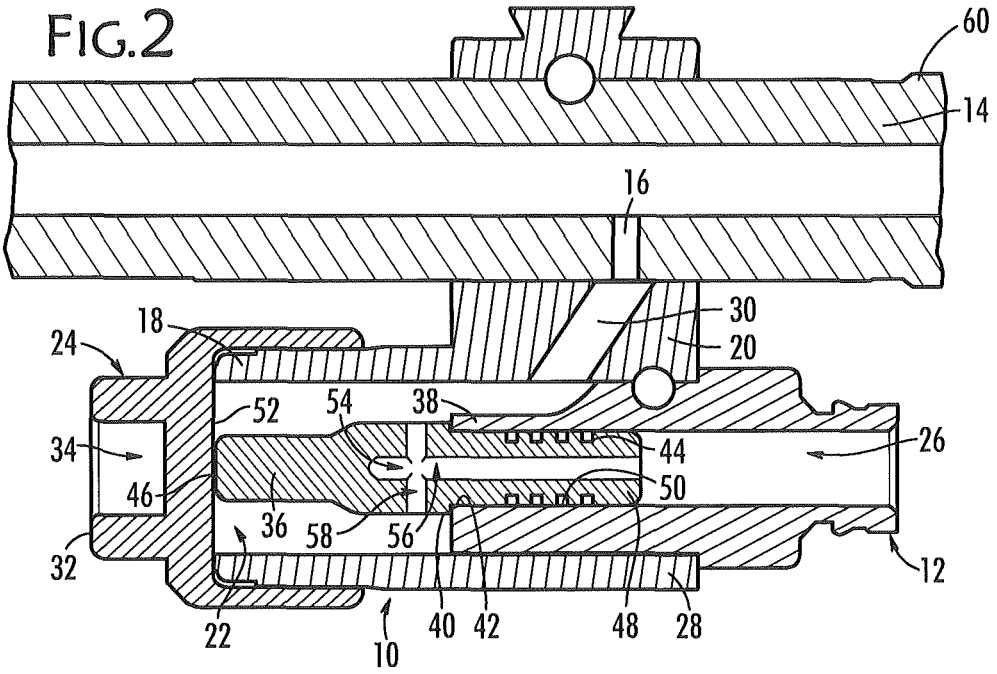
FIG. 2 is a side, cross-sectional view of a portion of a machine gun barrel and an attached gas block with a stem, according to an embodiment of the present invention.
Figure 3:
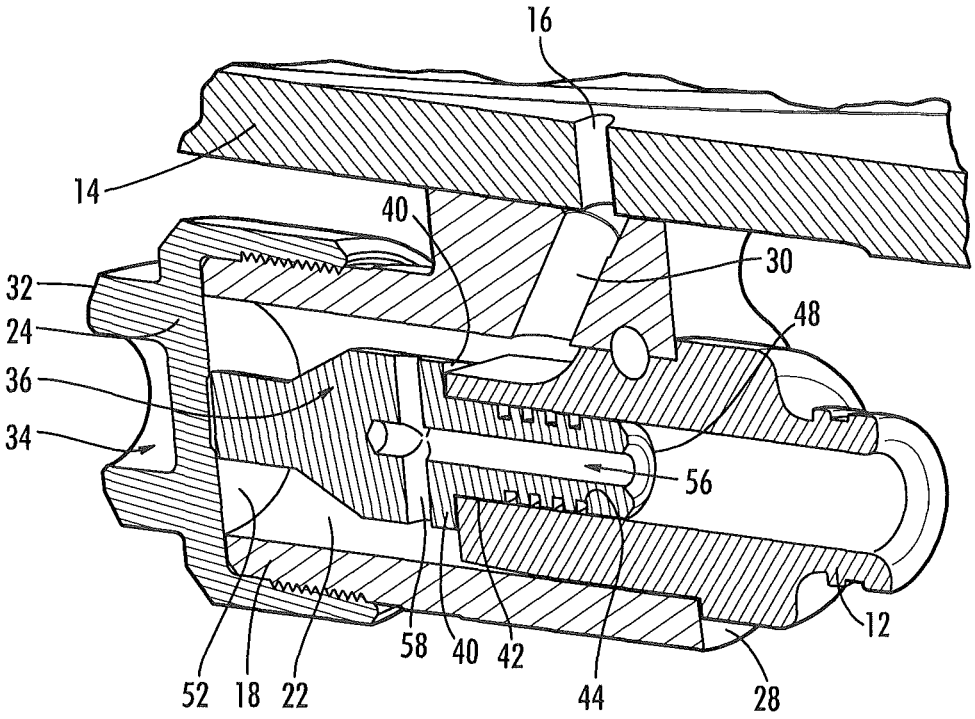
FIG. 3 is a rear, cross-sectional perspective view of the stem of FIG. 2.

As shown in FIG. 2, stem 36 is positioned inside body 20 of gas block 10, partially inserted into nozzle 12. Stem 36 has a stepped exterior surface 42 that has a ledge 40 to seat stem 36 against first end 38 of nozzle 12. Stem 36 has a first end 46 and an opposing second end 48. First end 46 is positioned against the interior surface 52 of cap 24, when stem 36 is seated against first end 38 to constrain stem 36 against axial movement particularly during machine gun firing. The second end 48 of stem 36 is thus received inside bore 26 of nozzle 12. Second end 48 may be beveled as shown for ease of insertion. Exterior surface 42 of stem 36 may be sealed against an interior surface 50 of nozzle 12 using a labyrinth seal which is a series of annular grooves 44. A labyrinth seal is a well-known type of mechanical seal that provides a tortuous path to help prevent fluid leakage.

Stem 36 has a passage 54 formed therein to constrain the flow of combustion gases from cavity 22 of body 20 of gas block 10 to flow into bore 26 in nozzle 12. The size of passage 54 in the stem 36 is selected to constrain gas flow sufficiently to offset the increase in firing range caused by the use of a suppressor on barrel 14 so that the firing rate slows to a more normal frequency. Firing rate control is critical to the proper functioning and reliability of the gun. Passage 54 may be formed by the combination of an axial bore 56 that intersects with a radial bore 58. Radial bore 58 may extend fully across the diameter of stem 36 or only partially. Axial bore 56 may be long enough to cross radial bore, if convenient, in the forming of passage 54. The cross-sectional area of axial bore 56 is critical to the firing rate so long as radial bore 58 is not smaller than axial bore 56 so that radial bore 58 not the limiting orifice.

Figure 7:
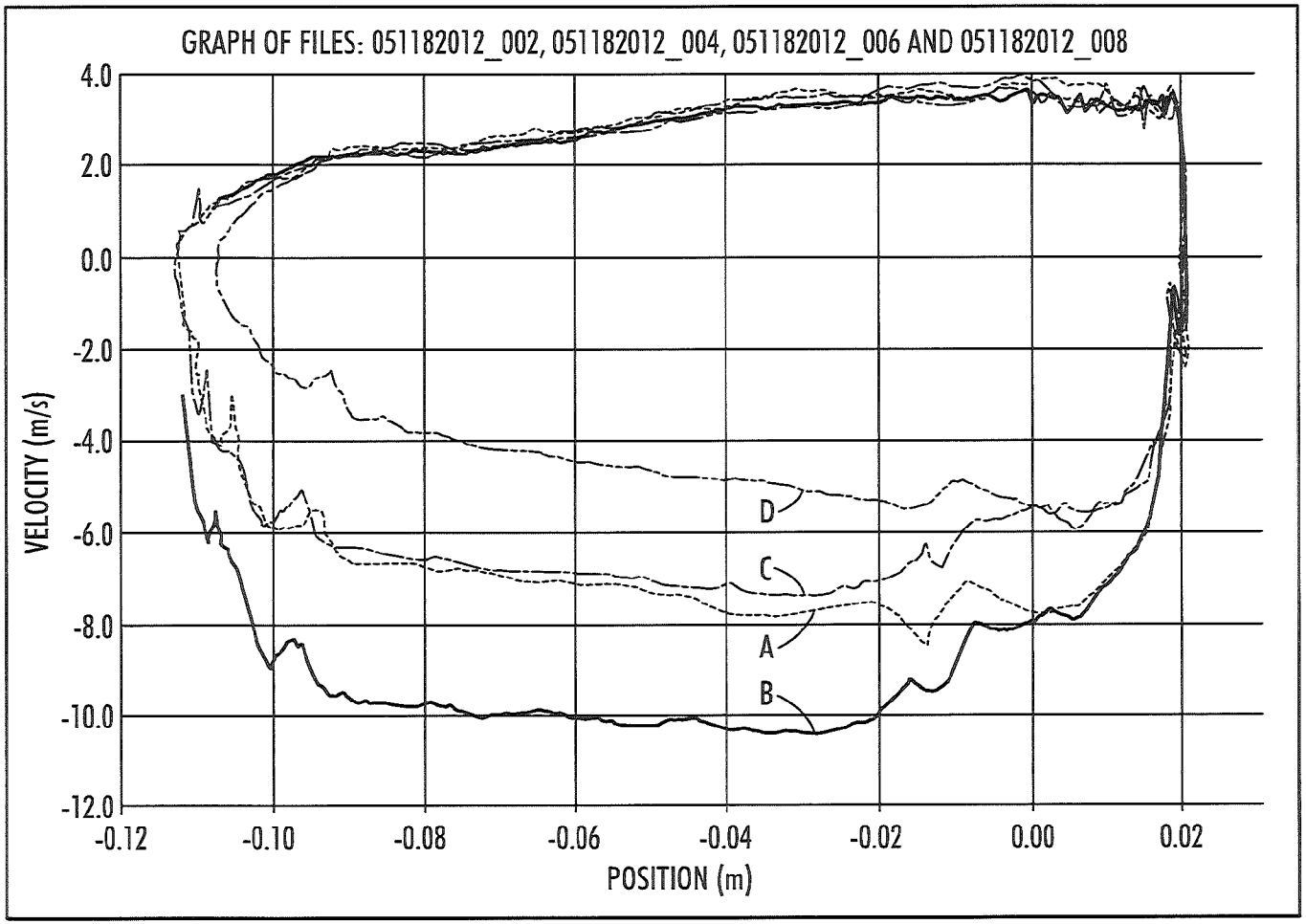
FIG. 7 is a graph showing the average velocity of the bolt carrier of a machine gun averaged over the firing of ten rounds as a function of its position with and without a suppressor and with and without the stem in the gas block.

FIG. 7 illustrates the effectiveness of the present stem 36 on controlling firing rate of a machine gun with and without a suppressor. FIG. 7 is a graph of the average position versus the average velocity of the bolt carrier over a set of to firings. There are four sets of traces of machine gun firing showing the responses for four combinations: with and without suppressor attached and with and without the present stem inserted in a prior art gas block.

One trace, A, corresponds to the machine gun with no suppressor on its barrel 14 and no stem 36 in its gas block 10, which may be viewed as the design rate of firing for the machine gun. The second trace, B, corresponds to the machine gun with a suppressor but no stem 36; it will be seen that the bolt carrier travels rearward about the same total distance, namely, 13 cm, but accelerates with respect to trade A, as it travels to a greater velocity—roughly $1/3^{rd}$ greater—than it does without the suppressor.

The third trace, C, corresponds to the bolt carrier position and velocity with both a suppressor and stem 36. Trace C approximately matches trace A, the design rate of firing for the machine gun without the suppressor and stem 36, i.e., a "normal" rate of firing. The fourth trace, D, corresponds to the bolt carrier in a machine gun without the suppressor but with stem 36. Stem 36 slows the bolt carrier by roughly the same $1/3^{rd}$ over the design case.

The embodiment described above requires no changes to a prior art gas block. However, with minor modifications to cap 24, alternative embodiments as described below may be used.

Figure 8:
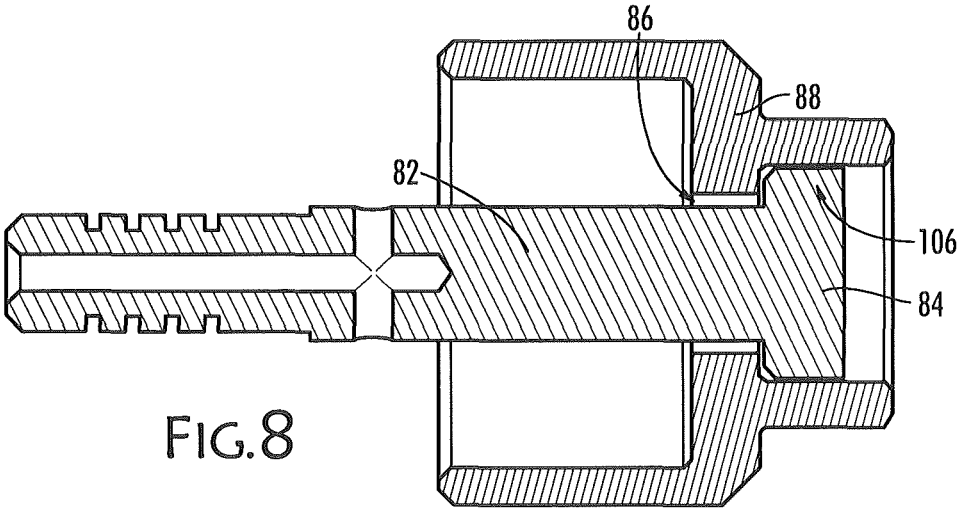
FIG. 8 is a side cross-sectional view of the present invention in which the stem is held in position by the gas block cap, according to an alternative embodiment of the invention.
Figure 9:
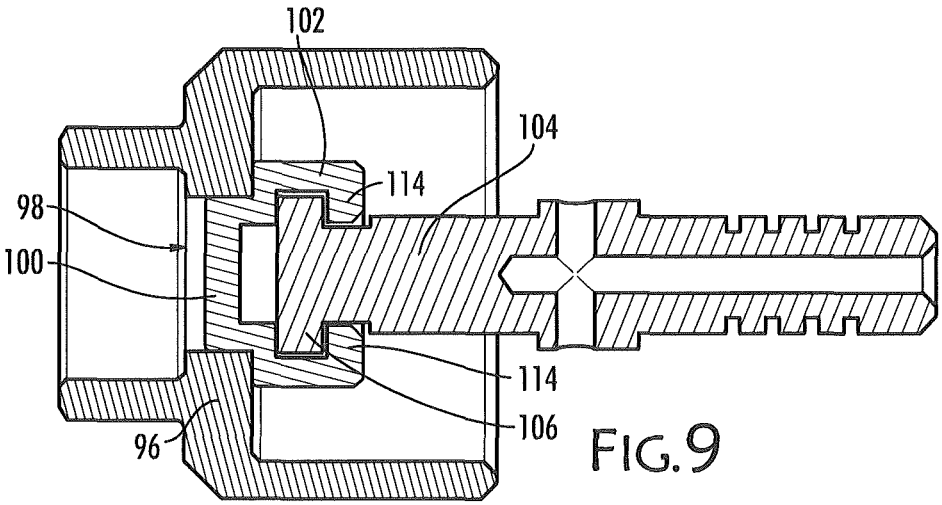
FIG. 9 is a side cross-sectional view in which the stem is held by a coupler in the gas block cap, according to another alternative embodiment of the present invention.
Figure 10:
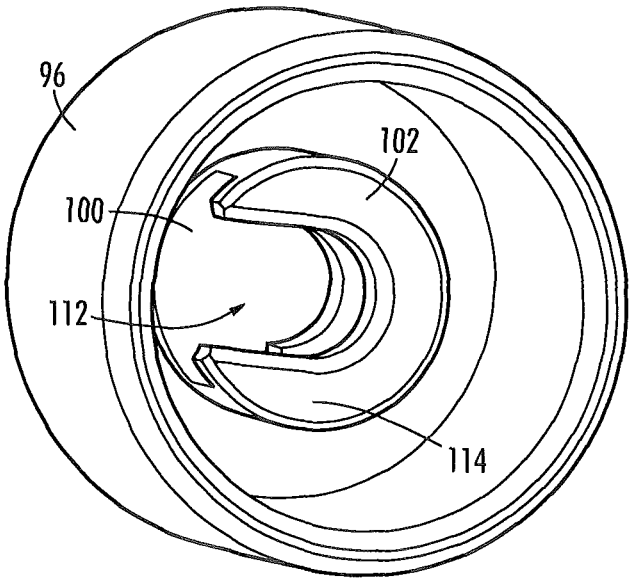
FIG. 10 is a perspective view showing the interior of the cap with the coupler for receiving a stem of the alternate embodiment shown in FIG. 9.
Figure 11:
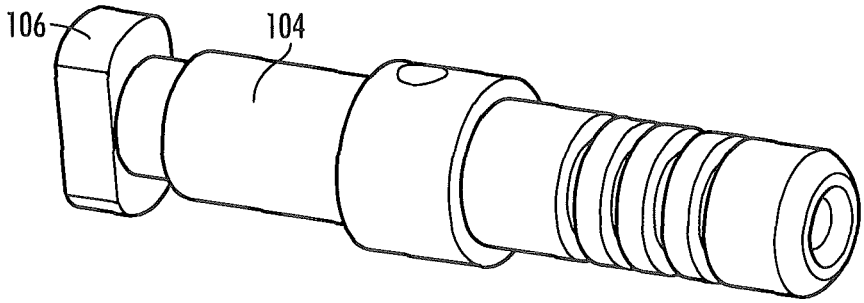
FIG. 11 is a perspective view of the stem as modified for insertion in the coupler shown in FIGS. 9 and 10.
Figure 12:
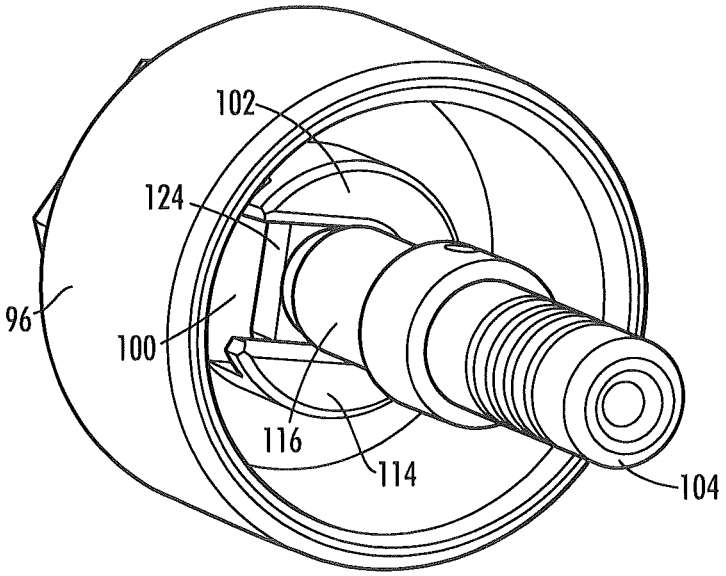
FIG. 12 is a perspective view of the stem of FIG. 11 inserted into the coupler shown in FIGS. 9 and 10.

As shown in FIG. 8, there is a stem 82 with an end flange 84, but otherwise configured in the same manner as stem 36, inserted through a hole 86 in a modified end cap 88. Hole 86 is large enough in diameter to receive stem 82 but not large enough to pass end flange 84.

As shown in FIGS. 9-12, another modified end cap 96 for attaching a stem 106 to body 20 may be made with a hole 98 formed therein to receive a first end 100 of a coupler 102 that holds a stem 104 in position in nozzle 12 (FIG. 2). Stem 104 has an end flange 106 as in the embodiment of FIG. 8 but which end flange 106 is received in a slot 112 (FIG. 10) formed in coupler 102. End flange 106 has opposing faces 114 (see also FIG. 11) that will pass into slot 112. Once flange 106 is received in slot 112, stem 104 may be given a quarter turn to lock it in place, flange 106 being received in slot 112 so that its faces 114 will hold stem 102 against axial movement. In use, stem 104 would be seated into position in nozzle 12 (FIG. 2), coupler 102 would be placed over end flange 106 of stem 104, rotated 90 degrees to lock stem 104 in coupler 102, and then modified end cap 96 would be threaded to body 20 over first end 100 of coupler 102.

Those skilled in the art of firearm operation will appreciate from the foregoing description of embodiments that many substitutions and modifications may be made to these embodiments without departing from the spirit and scope of the present invention, which is defined by the appended claims.

What is claimed is:

1. A gas block (10) for a machine gun having a barrel (14) with a hole (16) in said barrel (14), said gas block (10) comprising:

(a) a body (20) having a cavity (22) interior to said body (20), a passage (30) leading from said cavity (22) to an exterior of said body (20), a first end (18) and an opposing second end (28), said body (20) being attachable to said barrel (14) of said machine gun so that fluid can flow from said barrel (14) to said cavity (22);

(b) a cap 24 attached to said first end (18) of said body 20;

(c) a nozzle (12) secured to said body (20) and having a first end (38) and a second end (60), and, when said first end (38) of said nozzle (12) is secured to said body (20), said nozzle (12) is seated in said body (20) so that said first end (38) of said nozzle (12) is spaced apart from said first end (18) of said body (20) and said second end (60) of said nozzle (12) extends from said second end (28) of said body 20, said nozzle (12) having a bore (26) formed there through and in communication with said cavity (22) of said body (20) and said bore (26) of said nozzle (12) having a cross-sectional area; and (d) a removable stem (36) having a first end (46) and an opposing second end (48), said second end (48) being seated in said bore (26) of said first end (38) of said nozzle (12), said first end (46) of said stem (36) extending from said nozzle (12) into said cavity (22), said stem (36) having a passage (54) formed therein in fluid communication with said bore (26) of said nozzle (12) and said cavity (22) of said body (20), said passage (54) having a smaller cross-sectional area than said cross-sectional area of said bore (26).

2. The gas block 10 as recited in claim 1, wherein said removable stem (36) is dimensioned so that said first end (46) of said removable stem (36) engages said cap (24) at said first end (18) of said body (20).

3. The gas block 10 as recited in claim 1, wherein said second end (48) of said stem (36) has a labyrinth seal (44) formed thereon.

4. The gas block (10) as recited in claim 1, wherein said stem (36) has a stepped circumference to form a ledge (40), said ledge (40) seating against said first end (38) of said nozzle (12).

5. A device for use with a gas block (10) for a machine gun having a barrel (14) with a hole (16) in fluid communication with the interior of said barrel (14), said gas block (10) having (a) a body (20) having an interior cavity (22), a passage (30) leading from said cavity (22) to an exterior of said body (20), a first end (18) and an opposing second end (28), said body (20) being attachable to a barrel (14) of a machine gun so that said hole (16) in said barrel (14) and said passage (30) to said cavity (22) are in registration whereby fluid can flow from said barrel 14 to said cavity (22);

(b) a cap (24) attached to said first end (18) of said body 20; and (c) a nozzle (12) secured to said body (20) and having a first end (38) and an opposing second end (60), and, when said first end (38) of said nozzle (12) is secured to said body (20), said nozzle (12) is seated in said body (20) so that said first end (38) of said nozzle (12) is spaced apart from said first end (18) of said body (20) and said second end (60) of said nozzle (60) extends from said second end (28) of said body (20), said nozzle (12) having a bore (26) formed there through and in communication with said exterior of said gas block (10), said bore (26) of said nozzle (12) having a cross-sectional area, wherein said device comprises: a removable stem (36) having a first end (46) and a second end (48), said second end (48) being seated in said bore (26) of said first end (38) of said nozzle (12), said first end (46) extending from said nozzle (12) into said cavity (22), said stem (36) having a passage (54) formed therein in fluid communication with said bore (26) of said nozzle (12) and said cavity (22) of said body (20), said passage (54) having a smaller cross sectional area than said cross sectional area of said bore (26).

6. The device as recited in claim 5, wherein said removable stem (36) is dimensioned so that said first end (46) of said removable stem (36) engages said cap (24) at said first end (18) of said body (20).

7. The device as recited in claim 5, wherein said second end (48) of said stem (36) has a labyrinth seal (44) formed thereon.

8. The device as recited in claim 5, wherein said gas block (10) as recited in claim 1, wherein said stem (36) has a stepped circumference to form a ledge (40), said ledge (40) seating against said first end (38) of said nozzle (12).

* * * * *

UNITED STATES PATENT AND TRADEMARK OFFICE

CERTIFICATE OF CORRECTION

PATENT NO. : 9,243,859 B1
APPLICATION NO. : 14/565789
DATED : January 26, 2016
INVENTOR(S) : Moore et al.

It is certified that error appears in the above-identified patent and that said Letters Patent is hereby corrected as shown below:

On the title page, item 72 the inventors should be listed in the following order:

Charles A. Moore
John M. Beville
Harold L. Miller

Signed and Sealed this
Thirty-first Day of May, 2016

Michelle K. Lee

Michelle K. Lee
*Director of the United States Patent and Trademark Office*